US009478223B2

(12) United States Patent
Moon et al.

(10) Patent No.: US 9,478,223 B2
(45) Date of Patent: Oct. 25, 2016

(54) METHOD AND APPARATUS FOR DOWN-MIXING MULTI-CHANNEL AUDIO

(75) Inventors: Han-Gil Moon, Seoul (KR); Chul-Woo Lee, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 538 days.

(21) Appl. No.: 13/638,820

(22) PCT Filed: Apr. 23, 2010

(86) PCT No.: PCT/KR2010/002549

§ 371 (c)(1),
(2), (4) Date: Dec. 14, 2012

(87) PCT Pub. No.: WO2011/122731

PCT Pub. Date: Oct. 6, 2011

(65) Prior Publication Data

US 2013/0077793 A1 Mar. 28, 2013

(30) Foreign Application Priority Data

Mar. 29, 2010 (KR) ..... 10-2010-0028090

(51) Int. Cl.
*H04R 5/00* (2006.01)
*G10L 19/008* (2013.01)

(52) U.S. Cl.
CPC ..... *G10L 19/008* (2013.01)

(58) Field of Classification Search
CPC ... G10L 19/008; G10L 19/167; G10L 19/00; H04S 2420/03; H04S 2400/03
USPC ..... 381/23; 318/23
See application file for complete search history.

(56) References Cited

U.S. PATENT DOCUMENTS

| | | | | |
|---|---|---|---|---|
| 7,965,848 | B2 | 6/2011 | Villemoes et al. | |
| 2006/0233380 | A1* | 10/2006 | Holzer | G10L 19/008 381/23 |
| 2008/0221908 | A1 | 9/2008 | Thumpudi et al. | |
| 2009/0164224 | A1* | 6/2009 | Fejzo | 704/500 |

FOREIGN PATENT DOCUMENTS

| | | | |
|---|---|---|---|
| JP | 2001-195096 | A | 7/2001 |
| KR | 10-2007-0020012 | A | 2/2007 |
| KR | 10-2007-0088461 | A | 8/2007 |
| KR | 1020080103094 | A | 11/2008 |
| KR | 10-2009-0066186 | A | 6/2009 |

OTHER PUBLICATIONS

International Search Report (PCT/ISA/210) dated Apr. 12, 2011, in International Application No. PCT/KR2010/002549.
Written Opinion (PCT/ISA/237) dated Apr. 12, 2011, in International Application No. PCT/KR2010/002549.
Communication dated Oct. 30, 2015, issued by the Korean Intellectual Property Office in counterpart Korean Application No. 10-2010-0028090.

* cited by examiner

*Primary Examiner* — Alexander Jamal
(74) *Attorney, Agent, or Firm* — Sughrue Mion, PLLC

(57) ABSTRACT

Provided are a multi-channel audio down-mixing method and apparatus for selecting down-mix target channels based on a calculation of correlations between channels and then down-mixing the down-mix target channels. The method includes: calculating correlations between channels of multi-channel audio; selecting a first channel and a second channel, among the channels of the multi-channel audio, that are to be down-mixed, based on the calculated correlations; and down-mixing the selected first channel and the selected second channel.

16 Claims, 6 Drawing Sheets

METHOD AND APPARATUS FOR DOWN-MIXING MULTI-CHANNEL AUDIO

CROSS-REFERENCE TO RELATED PATENT APPLICATIONS

This application is a National Stage application under 35 U.S.C. §371 of PCT/KR2010/002549 filed on Apr. 23, 2010, which claims priority from Korean Patent Application No. 10-2010-0028090, filed on Mar. 29, 2010 in the Korean Intellectual Property Office, the disclosure of which is incorporated herein in its entirety by reference.

BACKGROUND

1. Field

Apparatuses and methods consistent with exemplary embodiments relate to down-mixing an audio signal, and more particularly, to efficiently down-mixing multi-channel audio.

2. Description of the Related Art

A related art method of coding multi-channel audio includes waveform audio coding and parametric audio coding. The waveform audio coding includes Moving Picture Expert Group-2 (MPEG-2) multi-channel (MC) audio coding, Advanced Audio Coding (AAC) MC audio coding, BSAC/ABS MC audio coding, and the like.

In the parametric audio coding, an audio signal is coded by decomposing the audio signal into components such as frequency, amplitude, and the like, and then by parameterizing information about the frequency, the amplitude, and the like.

In the parametric audio coding, mono-channel audio is generated by down-mixing a left channel and a right channel of stereo-channel audio, and then the generated mono-channel audio is coded. Here, a plurality of pieces of information used to restore the mono-channel audio to the stereo-channel audio are also coded, so that an audio decoding device may restore the stereo-channel audio from the mono-channel audio.

SUMMARY

Aspects of one or more exemplary embodiments provide a method and apparatus for coding and decoding multi-channel audio by efficiently down-mixing the multi-channel audio.

Aspects of one or more exemplary embodiments also provide a computer-readable recording medium having recorded thereon a program for executing the method.

According to an aspect of an exemplary embodiment, there is provided a method of down-mixing multi-channel audio, the method including operations of: calculating a correlation between channels of the multi-channel audio; selecting a first channel and a second channel that are to be down-mixed, based on the correlation; and down-mixing the selected first channel and the selected second channel.

The operation of calculating the correlation may include an operation of calculating a cross-correlation between the channels in a unit of a frame.

The operation of calculating the cross-correlation may include an operation of calculating a cross-correlation between the channels that are spatially adjacent to each other in a unit of a frame.

The operation of selecting the first channel and the second channel may include an operation of selecting two channels having a highest cross-correlation therebetween as the first channel and the second channel, based on a result of the calculating of the cross-correlation.

When two or more pairs of channels have a highest cross-correlation therebetween based on a result of the calculating of the cross-correlation, the operation of selecting the first channel and the second channel may include an operation of selecting two channels, in which at least one piece of additional information, which is required to restore the channels before down-mixing from an audio signal that is generated via the down-mixing, is coded at a highest compression rate, as the first channel and the second channel.

The at least one piece of additional information may include additional information required to restore powers of two channels before the down-mixing.

The method may further include operations of: calculating a correlation between channels including a mono channel, which is generated as a result of the down mixing of the first channel and the second channel, and excluding the first channel and the second channel; selecting a third channel and a fourth channel that are to be down-mixed, based on the correlation; and down-mixing the selected third channel and the selected fourth channel.

The method may further include operations of: calculating a correlation between a mono-channel, which is generated as a result of the down-mixing of the first channel and the second channel, and other channels excluding the first channel and the second channel; selecting a third channel to be down-mixed with the mono-channel, based on the correlation; and down-mixing the mono-channel and the selected third channel.

According to an aspect of another exemplary embodiment, there is provided a down-mixing device for down-mixing multi-channel audio, the down-mixing device including: a controller which calculates a correlation between channels of the multi-channel audio, and which selects a first channel and a second channel that are to be down-mixed, based on the correlation; and a down-mixer which down-mixes the selected first channel and the selected second channel.

According to an aspect of another exemplary embodiment, there is provided a method of down-mixing multi-channel audio, the method including: selecting a first channel and a second channel, among channels of multi-channel audio, that are to be down-mixed, based on correlations between the channels of the multi-channel audio; and down-mixing the selected first channel and the selected second channel.

According to an aspect of another exemplary embodiment, there is provided a computer-readable recording medium having recorded thereon a program for executing the method of down-mixing multi-channel audio.

BRIEF DESCRIPTION OF THE DRAWINGS

The above and other features and advantages will become more apparent by describing in detail exemplary embodiments with reference to the attached drawings in which.

DETAILED DESCRIPTION OF EXEMPLARY EMBODIMENTS

Figure 1:
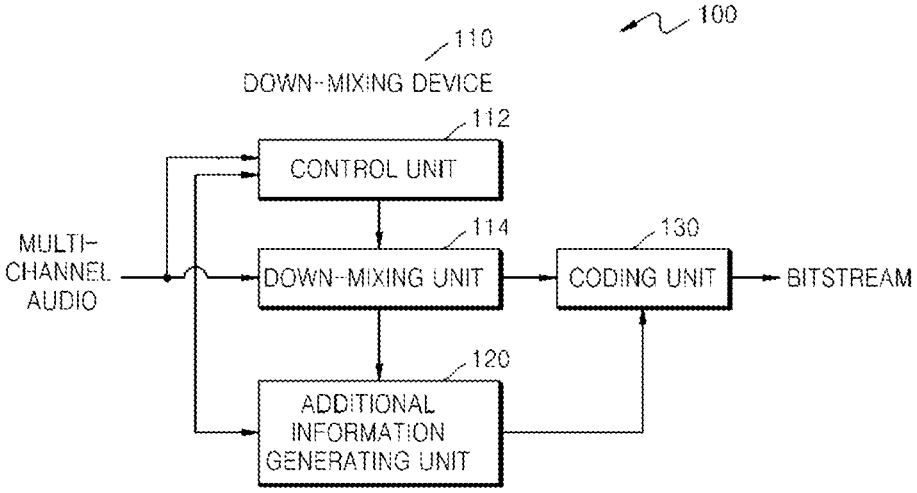
FIG. 1 illustrates an apparatus for coding multi-channel audio according to an exemplary embodiment.

Hereinafter, exemplary embodiments will be described in detail with reference to the attached drawings. Like reference numerals in the drawings denote like elements.

FIG. 1 illustrates an apparatus 100 for coding multi-channel audio according to an exemplary embodiment. FIG. 1 illustrates a multi-channel audio coding apparatus 100 including a down-mixing device 110.

Referring to FIG. 1, the multi-channel audio coding apparatus 100 includes a control unit 112 (e.g., controller), a down-mixing unit 114 (e.g., down-mixer), an additional information generating unit 120 (e.g., additional information generator), and a coding unit 130 (e.g., coder).

The down-mixing device 110 receives N-channel audio (e.g., Ch. 1 through Ch. N) and down-mixes the received N-channel audio. The down-mixing device 110 may generate one mono-channel audio or M-channel audio (where M is less than N) by down-mixing the N-channel audio. For example, the down-mixing device 110 may down-mix the N-channel audio into 3-channel audio or 6-channel audio which correspond to 2.1 channel audio or 5.1 channel audio.

According to the present exemplary embodiment, the down-mixing device 110 generates a first mono-channel by selecting two channels from among N-channels and down-mixing the two channels, and then generates a second mono-channel by down-mixing the first mono-channel with another channel. The down-mixing device 110 may repeat a procedure of adding another channel to a mono-channel that is a down-mixing resultant channel and down-mixing the mono-channel and the other channel to thus generate final mono-channel audio or M-channel audio.

When the down-mixing device 110 down-mixes the N-channel audio, the down-mixing device 110 may down-mix similar channels so as to perform a down-mixing operation with minimum entropy. Thus, according to the present exemplary embodiment, the down-mixing device 110 down-mixes channels having a high correlation therebetween, so that multi-channel audio may be coded at a high compression rate.

The control unit 112 sequentially selects down-mix target channels from the multi-channel audio. Here, the control unit 112 calculates a correlation between N-channels and then selects two channels having a high correlation therebetween. This will be described in detail with reference to FIGS. 4 through 6.

The down-mixing unit 114 sequentially down-mixes the channels that are selected by the control unit 112 based on the correlation calculation. The down-mixing unit 114 generates a first mono-channel by down-mixing the two channels that are selected from the multi-channel audio by the control unit 112 based on the correlation calculation, and down-mixes the first mono-channel with another channel that is selected by the control unit 112 based on a correlation calculation between the first mono-channel and other channels that are not down-mixed. When the control unit 112 repeatedly selects channels based on a correlation calculation, the down-mixing unit 114 repeats down-mixing of selected channels and a mono-channel and thus generates the final mono-channel audio or the M-channel audio.

When down-mix target channels are selected by the control unit 112 based on a plurality of reference channels, channels are down-mixed with respect to the plurality of reference channels, respectively. Also, as will be described below with reference to FIG. 7, when multi-channels are grouped based on their spatial dispositions, channels included in each group are down-mixed based on selection by the control unit 112, and thus a mono-channel is generated.

The additional information generating unit 120 generates additional information for restoring the multi-channels in a down-mixed channel. Whenever the down-mixing unit 114 sequentially down-mixes the multi-channels, the additional information generating unit 120 generates the additional information for restoring the multi-channels in the down-mixed channel. The additional information generating unit 120 generates information to determine powers of two down-mixed channels, and information to determine phases of the two down-mixed channels.

Also, whenever down-mixing is performed, the additional information generating unit 120 generates information that indicates which channels are down-mixed. Since the down-mixing is not performed according to a fixed order but channels that are selected by the control unit 112 based on a correlation calculation are sequentially down-mixed, the additional information generating unit 120 generates additional information indicating which channels are down-mixed. For example, the additional information generating unit 120 may generate information about a down-mixing order of channels.

Whenever the down-mixing is repeatedly performed, the additional information generating unit 120 repeats generation of a plurality of pieces of information for restoring down-mixed channels in a mono-channel. For example, in a case where 22 channels are repeatedly and sequentially down-mixed 21 times and thus one mono-channel is generated, each of information about a down-mixing order, information to determine power of a channel, and information to determine a phase of a channel is generated 21 times. Also, according to the present exemplary embodiment, as will be described below, information to determine power of a channel and information to determine a phase of a channel may be generated for each of a plurality of sub-bands, so that, when the number of sub-bands is k, 21*k pieces of information to determine a power of a channel are generated, and 21*k pieces of information to determine a phase of a channel are generated.

The information to determine a power of a channel and the information to determine a phase of a channel will be described in detail with reference to FIGS. 2 and 3.

(1) Information to Determine a Power of a Channel

In parametric audio coding, each channel of multi-channel audio may be converted into a frequency domain, and information about a power and a phase of each channel may be coded in the frequency domain. This will be described in detail with reference to FIG. 2.

Figure 2:
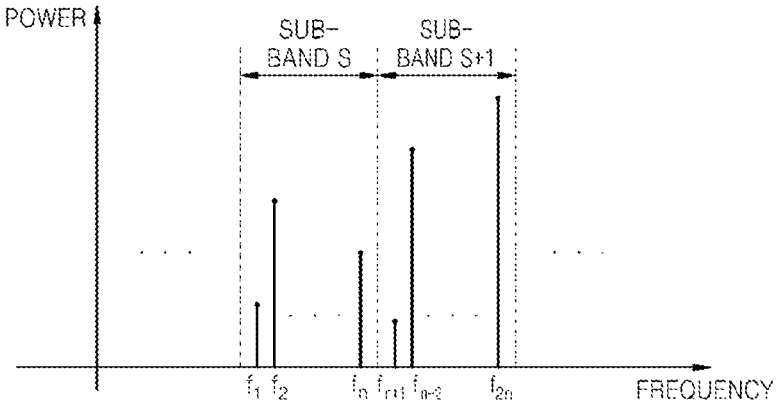
FIG. 2 illustrates sub-bands in parametric audio coding.

FIG. 2 illustrates sub-bands in parametric audio coding.

FIG. 2 illustrates a frequency spectrum of a frame of an audio signal which is converted into a frequency domain. When fast Fourier transformation (FFT) is performed on an audio signal of a channel, the audio signal may be expressed as values that are discrete in the frequency domain. That is, the audio signal may be expressed as the sum of a plurality of sine waves.

In the parametric audio coding, when the audio signal is converted into the frequency domain, the frequency domain is divided into a plurality of sub-bands, and information to determine powers of two channels and information to determine phases of the two channels that are down-mixed in each of the sub-bands are coded. Here, a plurality of pieces of additional information about powers and phases in a sub-band S are coded, and then a plurality of pieces of additional information about powers and phases in a sub-band S+1 are coded. That is, a plurality of pieces of additional information about powers and phases are generated and coded in each of the sub-bands, so that a decoder may restore channels, i.e., restore to a state prior to down-mixing, from a frequency spectrum of mono-channel audio.

When it is assumed that a channel p and a channel q are down-mixed to generate a mono-channel, an audio coding method according to an exemplary embodiment uses a vector of a power of the channel p and a vector of a power of the channel q in the sub-band S so as to minimize the number of a plurality of pieces of additional information which are coded as a plurality of pieces of information to determine the power of the channel p and the power of the channel q in the sub-band S. Here, an average value of powers in frequencies f1, f2, . . . , fn of a frequency spectrum of the channel p that is converted into the frequency domain is the power of the channel p in the sub-band S, and an average value of powers in frequencies f1, f2, . . . , fn of a frequency spectrum of the channel q that is converted into the frequency domain is the power of the channel q in the sub-band S.

Figure 3:
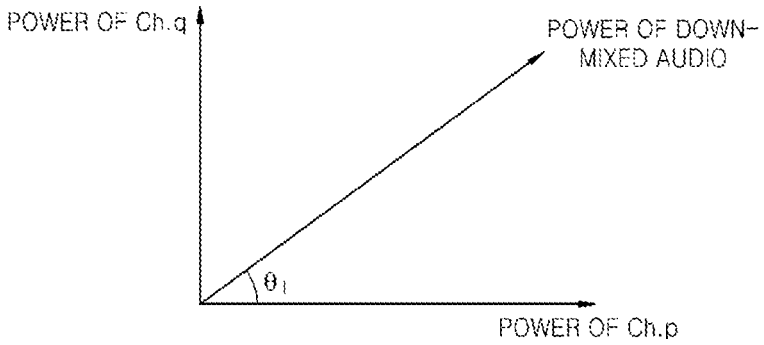
FIG. 3 illustrates a method of generating information to determine a power of a down-mixed channel, according to an exemplary embodiment.

FIG. 3 illustrates a method of generating information to determine a power of a down-mixed channel, according to an exemplary embodiment.

Referring to FIG. 3, a power of the mono-channel in a sub-band S, which is generated via down-mixing, is expressed as the sum of a vector of a power of a channel p and a vector of a power of a channel q in a two-dimensional vector space in which the vector of the power of the channel p and the vector of the power of the channel q in the sub-band S form a predetermined angle (e.g., 90 degrees). Since it is possible to obtain the power of the mono-channel from a frequency spectrum of mono-channel audio, if θI is coded as additional information, a decoder may obtain both the power of the channel p and the power of the channel q in the sub-band S.

With respect to the rest of the sub-bands, the additional information generating unit 120 generates at least one of information about an angle between a vector of a power of the mono-channel generated via down-mixing and a vector of a power of the channel p, and information about an angle between the vector of the power of the mono-channel and a vector of a power of the channel q, as information to determine powers of two down-mixed channels.

(2) Information to Determine a Phase

In the audio coding method according to the present exemplary embodiment, the additional information generating unit 120 generates information about a phase difference between the channel p and the channel q in the sub-band S, as information to determine phases of the channels p and q in the sub-band S.

According to the present exemplary embodiment, when the down-mixing unit 114 down-mixes the channel p and the channel q, the down-mixing unit 114 adjusts the phase of the channel q and then down-mixes the channels p and q so as to allow the phases of the channels p and q in the sub-band S to be equal to each other. The down-mixing unit 114 generates a channel q of which phase is adjusted to be equal to the phase of the channel p, and then down-mixes the channel p and the phase-adjusted channel q. Since a phase of the mono-channel generated via down-mixing is equal to the phase of the channel p, if the additional information generating unit 120 generates information about a difference between the phase of the channel p and the phase of the channel q before the phase-adjustment, the decoder may determine the phase of the channel p and the phase of the channel q from the phase of the mono-channel.

In a case of the sub-band S, the down-mixing unit 114 adjusts a phase of the channel q in each of the frequencies f1, f2, . . . , fn so as to allow the phase of the channel q to be equal to a phase of the channel p in each of the frequencies f1, f2, . . . , fn. In a case where the phase of the channel q is adjusted in the frequency f1, when the channel p in the frequency f1 is expressed as $|Ch1|e^{i(2\pi f1t+\theta 1)}$, and the channel q in the frequency f1 is expressed as $|Ch2|e^{i(2\pi f1t+\theta 2)}$), a channel q (i.e., Ch2') that is phase-adjusted in the frequency f1 may be calculated by using exemplary Equation 1. Here, θ1 indicates the phase of the channel p in the frequency f1, and θ2 indicates the phase of the channel q in the frequency f1.

$$Ch2'=Ch2*e^{i(\theta 1-\theta 2)}=|Ch2|e^{i(2\pi f1t+\theta 1)} \quad \text{[Equation 1]}$$

By using exemplary Equation 1, the phase of the channel q in the frequency f1 becomes equal to the phase of the channel p. The phase-adjustment is repeated with respect to the channel q in each of f2, f3, . . . , fn that are other frequencies of the sub-band S, so that the channel q that is phase-adjusted in the sub-band S is generated.

Since the phase of the channel q that is phase-adjusted in the sub-band S is equal to the phase of the channel p, if 'θ1−θ2' that is a difference between the phases of the channels p and q is coded, the decoder to decode the down-mixed audio may obtain the phase of the channel q. Also, since the phase of the channel p is equal to the phase of the mono-channel generated by the down-mixing unit 114, it is not required to separately code information about the phase of the channel p.

In addition, the aforementioned method of coding the information to determine the powers of the channels p and q by using a power vector of channel audio in the sub-band S, and the method of coding the information to determine the phases of the channels p and q in the sub-band S by using the phase-adjustment may be separately used or may be combined and used.

In other words, information to determine powers of down-mixed channels may be coded by using vectors according to the present exemplary embodiment, and information to determine phases of the down-mixed channels may be coded according to a related art method. Alternatively, the information to determine the powers of the down-mixed channels may be coded according to the related art method, and the information to determine the phases of the down-mixed channels may be coded according to the present exemplary embodiment. Obviously, the information to determine the powers and the phases of the down-mixed channels may be coded by using all of the two methods according to the present exemplary embodiment.

Referring back to FIG. 1, the coding unit 130 codes the mono-channel audio or the M-channel audio, which are down-mixed and then are generated by the down-mixing unit 114. When audio output from the down-mixing unit 114 is an analog signal, the coding unit 130 converts the analog signal into a digital signal and then codes symbols by using a predetermined algorithm. Examples of the predetermined algorithm are limitless and the coding unit 130 may use any algorithm to generate a bitstream by coding an audio signal. Also, the coding unit 130 codes the additional information to restore the multi-channels from the mono-channel audio, which is generated by the additional information generating unit 120.

Hereinafter, a method of down-mixing multi-channel audio, performed by the down-mixing device 110, will be described in detail with reference to FIGS. 4 through 6.

Figure 4:
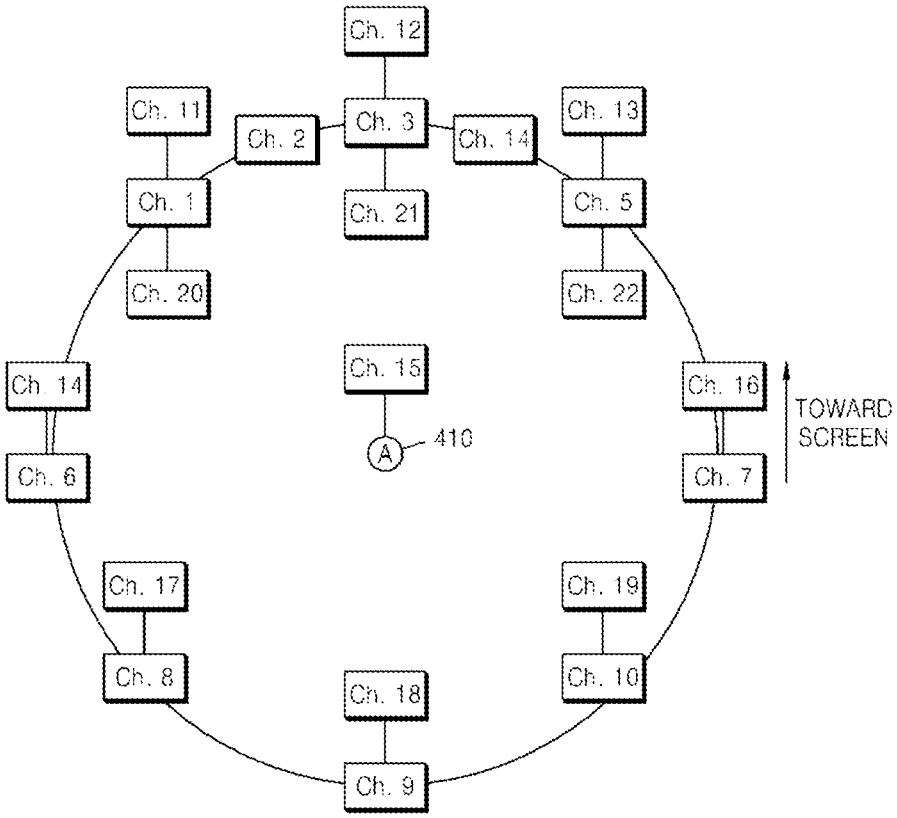
FIG. 4 illustrates multi-channel audio, according to an exemplary embodiment.

FIG. 4 illustrates multi-channel audio, according to an exemplary embodiment.

The multi-channel audio may be disposed in a direction toward a screen in a three-dimensional (3D) space around a listener 410. 10 channels of Ch.1 through Ch.10 may be disposed on the same plane as the listener 410, and 9 channels of Ch.11 through Ch.19 may be disposed on a plane higher than the listener 410. Also, 3 channels of Ch.20 through Ch.22 are disposed on a plane lower than the listener 410.

(3) Selection of Down-Mix Target Channel

The control unit 112 may calculate a correlation between two channels by grouping the channels Ch.1 through Ch.22, and based on a result of the calculation, the control unit 112 may select two channels having a highest correlation therebetween as down-mix target channels.

For example, as the result of the calculation, if two channels Ch.3 and Ch.12 have a highest correlation therebetween, the control unit 112 selects the two channels as down-mix target channels, and then the down-mixing unit 114 performs down-mixing and thus generates a first mono-channel.

When the first mono-channel is generated, the control unit 112 recalculates a correlation between the first mono-channel and other channels that are not down-mixed.

If the first mono-channel is generated by down-mixing the two channels of Ch.3 and Ch.12, the correlation between the first mono-channel and the 20 other channels excluding Ch.3 and Ch.12 is recalculated. In other words, since one channel is deducted as a result of the down-mixing, a correlation among all of 21 channels including the first mono-channel may be calculated to select down-mix target channels. The 21 channels may be grouped, a correlation with respect to a total of 210 groups may be calculated, and then based on a result of the calculation, two channels to be secondly down-mixed may be selected.

Since the selection is based on the calculation of the correlation, the two channels that are selected for second down-mixing may not include the first mono-channel. The down-mixing device 110 may repeat the selection and down-mixing of two channels and thus may generate the mono-channel audio or the M-channel audio.

Also, according to another exemplary embodiment, in the second down-mixing or down-mixing after the second down-mixing, a previously generated mono-channel and another channel may be down-mixed.

For example, the control unit 112 may calculate a correlation between the first mono-channel that is generated by down-mixing the two channels of Ch.3 and Ch.12, and other channels excluding Ch.3 and Ch.12, and then may select another channel to be down-mixed with the first mono-channel. Since the number of channels excluding the first mono-channel is 20, the control unit 112 may calculate the correlation between the first mono-channel and each of the 20 channels and then may select a channel to be secondly down-mixed. As a result of the correlation calculation, if a channel Ch.21 is selected, the down-mixing unit 114 down-mixes the first mono-channel and the channel Ch.21 and thus generates a second mono-channel. The down-mixing device 110 may repeat the selection of channels to be additionally down-mixed, and the down-mixing of them, and thus may generate the mono-channel audio or the M-channel audio.

Figure 5:
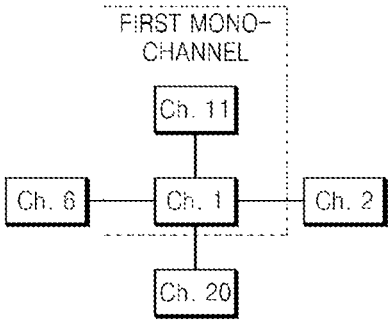
FIG. 5 illustrates adjacent channels, according to an exemplary embodiment.

FIG. 5 illustrates adjacent channels, according to an exemplary embodiment.

According to the present exemplary embodiment, the control unit 112 may calculate a correlation among channels that are spatially adjacent to each other from among the channels disposed around the listener 410 in the 3D space as illustrated in FIG. 2, and then may select down-mix target channels. In a case of a channel Ch.1, the channel Ch.1 is adjacent to a channel Ch.11 disposed above the channel Ch.1, is adjacent to a channel Ch.20 disposed below the channel Ch.1, is adjacent to a channel Ch.6 disposed at a left side of the channel Ch.1, and is adjacent to a channel Ch.2 disposed at a right side of the channel Ch.1. When the control unit 112 calculates a correlation among channels, if the control unit 112 calculates the correlation with respect to the total of 210 groups of 22 channels as described above, the correlation calculation may be time consuming and thus may be inefficient.

Thus, the control unit 112 may calculate only a correlation between adjacent channels, and thus may calculate a correlation four times with respect to the channels Ch.11, Ch.20, Ch.6, and Ch.2 that are adjacent to the channel Ch.1. Similarly, with respect to the channel Ch.2, the control unit 112 may calculate a correlation twice with respect to the channels Ch.1 and Ch.3, and with respect to the channel Ch.3, the control unit 112 may calculate a correlation four times with respect to the channels Ch.12, Ch.21, Ch. 2, and Ch.4.

As a result of the correlation calculation, when the channels Ch.1 and Ch.11 are selected as down-mix target channels, when the control unit 112 selects next down-mix target channels, the control unit 112 may regard a mono-channel, which is obtained by grouping the channels Ch.1 and Ch.11, as one channel and may recalculate a correlation between adjacent channels. In other words, the mono-channel that is generated by down-mixing the channels Ch.1 and Ch.11 may be regarded as one channel, and then a correlation between the mono-channel and each of the channels Ch.20, Ch.6 and Ch.2 may be calculated.

According to another exemplary embodiment, a mono-channel may be generated in a manner that at least one reference channel may be set, and the N-channels adjacent to the reference channel are down-mixed one by one. One reference channel or a plurality of reference channels may be possible in exemplary embodiments.

For example, referring to FIG. 2, the control unit 112 sets a channel Ch.3 as a reference channel, and selects one of channels adjacent to the channel Ch.3 based on a correlation calculation. When the down-mixing unit 114 generates a first mono-channel by down-mixing the selected channel and the channel Ch.3, the control unit 112 recalculates a correlation between the first mono-channel and the adjacent channels and thus selects a channel to be secondly down-mixed. The down-mixing unit 114 generates a second mono-channel by down-mixing the first mono-channel and the selected channel, and then the control unit 112 selects a channel to be thirdly down-mixed. In this manner, the channels adjacent to the channel Ch.3 are down-mixed one by one while the selection of down-mix target channels and the down-mixing of them are repeated, so that the mono-channel audio or the M-channel audio may be generated.

The down-mixing device 110 may set a plurality of reference channels and may repeat a process of down-mixing channels adjacent to the reference channels. For example, the down-mixing device 110 may set channels Ch.1, Ch.5, Ch.8, and Ch.10 as reference channels, and may down-mix channels one by one (simultaneously among reference channels or sequentially) which are adjacent to the reference channels.

Figure 6:
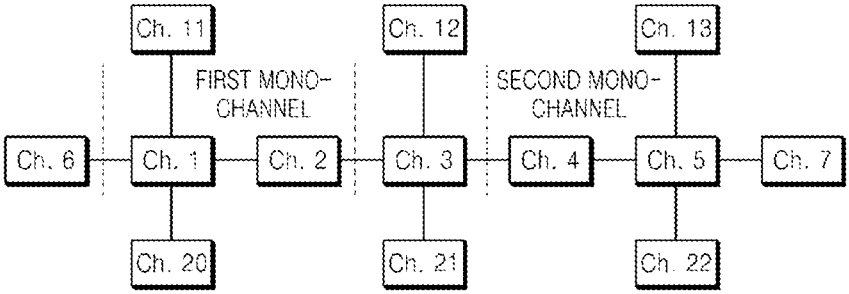
FIG. 6 illustrates adjacent channels, according to another exemplary embodiment.

FIG. 6 illustrates adjacent channels, according to another exemplary embodiment.

Referring to FIG. 6, in a case where a plurality of reference channels are set and the N-channels adjacent to the reference channels are sequentially down-mixed, one channel may be shared in down-mixing operations.

For example, in a case where the channels Ch.1 and Ch.5 shown in FIG. 2 are set as reference channels, and channels adjacent to the reference channels are down-mixed based on a correlation calculation, if the channels Ch.1 and Ch.2 are down-mixed and thus a first mono-channel is generated, and the channels Ch.5 and Ch.4 are down-mixed and thus a second mono-channel is generated, only the channel Ch.3 exists between the first mono-channel and the second mono-channel. In this case, the channel Ch.3 is included in adjacent channel candidates (i.e., channels Ch.6, Ch.11, Ch.20, Ch.3., Ch.12 and Ch.21) to be additionally down-mixed with the first mono-channel and is also included in adjacent channel candidates (i.e., channels Ch.7, Ch.13, Ch.22, Ch.3, Ch.12 and Ch.21) to be additionally down-mixed with the second mono-channel. In this case, the channel Ch.3 may be divided into two channels by multiplying a power of the channel Ch.3 by $1/\sqrt{2}$, and the two divided channels may be regarded as two different channels and thus may be down-mixed with the first and second mono-channels.

Figure 7:
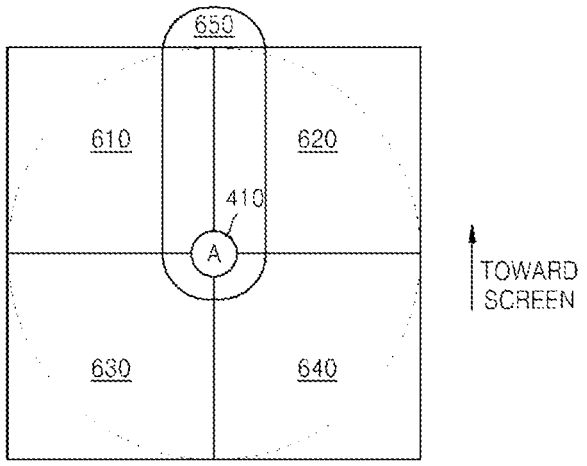
FIG. 7 illustrates a down-mix group, according to an exemplary embodiment.

FIG. 7 illustrates a down-mix group, according to an exemplary embodiment.

When down-mix target channels are selected based on the correlation calculation described above with reference to FIG. 4, the down-mix target channels may be unrelated to spatial disposition. For example, when the channels Ch.1 and Ch.10 have a highest correlation therebetween, the channels Ch.1 and Ch.10 that are spatially farthest from each other may be selected as the down-mix target channels. However, it is understood that one or more other exemplary embodiments are not limited thereto. For example, if down-mixing is performed to generate 2.1 channel audio or 5.1 channel audio, the down-mix target channels may be selected in consideration of spatial disposition.

To do so, the channels that are disposed in the 3D space shown in FIG. 4 are grouped into a plurality of groups 610 through 650 as shown in FIG. 7, and only channels included in each of the groups 610 through 650 are down-mixed. FIG. 7 corresponds to a case in which the 22 channels shown in FIG. 4 are grouped to correspond to 5 channels. In the direction toward the screen, the 22 channels are grouped into the group 610 including channels Ch.1, Ch.2, Ch.3, Ch.6, Ch.11, Ch.12, Ch.14, Ch.20 and Ch.21 which are disposed at a left front side of the listener 410, the group 620 including channels Ch.3, Ch.4, Ch.5, Ch.7, Ch.12, Ch.13, Ch16, Ch.21 and Ch.22 which are disposed at a right front side of the listener 410, the group 630 including channels Ch.6, Ch.8, Ch.9, Ch.14, Ch.17 and Ch.18 which are disposed at a left rear side of the listener 410, the group 640 including channels Ch.7, Ch.9, Ch.10, Ch.16, Ch.18 and Ch.19 which are disposed at a right rear side of the listener 410, and the group 650 including channels Ch.3, Ch.12, Ch.15, and Ch.21.

Each of channels disposed at each of boundaries between the groups 610 through 650 is divided into two channels by multiplying a power of each of the channels by $1/\sqrt{2}$ as described above with reference to FIG. 6, and the two divided channels are regarded as different channels and thus are down-mixed in each of the groups 610 through 650.

The control unit 112 calculates a correlation between only channels included in each of the groups 610 through 650 so as to select down-mix target channels, and based on a result of the calculation, the control unit 112 selects down-mix target channels in each of the groups 610 through 650. Since only channels that are spatially adjacent to each other in each of the groups 610 through 650 are down-mixed, the multi-channel audio may be converted to correspond to the 2.1 channel audio or the 5.1 channel audio.

(4) Calculation of a Correlation

As described above with reference to FIGS. 4 through 6, the control unit 112 may calculate a correlation between N-channels by using exemplary Equation 2.

[Equation 2]

$$ICC = \frac{\sum_{k=-l}^{l} x_i(k) * x_j(k+d)}{\sqrt{\sum_{k=l}^{l} x_i^2(k) * \sum_{k=-l}^{l} x_j^2(k)}}$$

A cross-correlation between a channel i and a channel j may be calculated in a unit of a frame.

According to a method of calculating a correlation between two channels in a time domain, the control unit 112 may calculate the cross-correlation between 2L+1 symbols included in an audio frame of the channel i and 2L+1 symbols included in an audio frame of the channel j, by using exemplary Equation 2.

Here, $x_i(k)$ indicates a symbol of the channel i, and $x_j(k)$ indicates a symbol of the channel j. Also, d may be a constant that varies depending on exemplary embodiments, and, for example, may be '0' or may be ½ of the number of symbols included in one audio frame. For example, if one audio frame includes 1024 symbols, d may be set as 512 and then the cross-correlation may be calculated.

In a case where the cross-correlation is calculated in a unit of a frame, a down-mix target channel is also selected in a unit of a frame. For example, the channel Ch.11 may be selected as a channel to be down-mixed with the channel Ch.1 in an $n^{th}$ audio frame, and the channel Ch.20 may be selected as a channel to be down-mixed with the channel Ch.1 in an $n+1^{th}$ audio frame.

The cross-correlation may be calculated in a frequency domain. When FFT is performed on symbols included in one audio frame, the symbols are expressed as discrete values indicating a power of a frequency component in the frequency domain.

The control unit 112 may calculate the cross-correlation between the channel i and the channel j based on the discrete values of the frequency domain, which are generated as a result of the FFT. The control unit 112 calculates the cross-correlation between values indicating a power of a frequency component generated by performing the FFT on the symbols of the channel i, and values indicating a power of a frequency component generated by performing the FFT on the symbols of the channel j, by using exemplary Equation 2.

When calculated in the frequency domain, $x_i(k)$ indicates the values indicating the power of the frequency component generated by performing the FFT on the symbols of the channel i, and $x_j(k)$ indicates the values indicating the power of the frequency component generated by performing the FFT on the symbols of the channel j. As described above, d may be '0', and L may be a value to set a frequency region to obtain the cross-correlation. For example, L may be set so that values of powers of a frequency component from f=0 Hz to f=512 Khz may be compared.

Also, the frequency domain may be divided into the plurality of sub-bands as shown in FIG. 2, and a cross-correlation may be calculated with respect to each of the sub-bands. For example, a cross-correlation between values indicating powers of a frequency component in a sub-band S of the channel i, and values indicating powers of a frequency component in a sub-band S of the channel j may be calculated, and a cross-correlation between values indicating powers of a frequency component in a sub-band S+1 of the channel i, and values indicating powers of a frequency component in a sub-band S+1 of the channel j may be calculated. Similarly, a calculation of a cross-correlation is repeated with respect to all of the sub-bands.

When the cross-correlation is calculated with respect to all of the sub-bands, the control unit 112 may select a down-mix target channel in each of the sub-bands. Since the cross-correlation is calculated in each of the sub-bands, the down-mix target channel may vary in each of the sub-bands. For example, as a result of the cross-correlation calculation in the sub-band S, although the channel Ch.11 is selected as a channel to be down-mixed with the channel Ch.1, in the sub-band S+1, the channel Ch.20 may be selected as a channel to be down-mixed with the channel Ch.1.

(5) Process in the Case of Channels Having the Same Correlation

When a correlation between two channels is calculated as described above with reference to FIGS. 4 through 6, correlations of two or more pairs of channels may be the same.

For example, when the control unit 112 calculates correlations among the 22 channels shown in FIG. 4, the correlation between the channels Ch.1 and Ch.11, and the correlation between the channels Ch.5 and Ch.13 may be equal to each other and may be the highest levels. Here, the control unit 112 selects a channel in which additional information to restore multi-channels from a down-mixed channel can be coded at a highest compression rate, wherein the additional information is generated by the additional information generating unit 120. As described above with reference to FIGS. 2 and 3, since information to determine powers of down-mixed channels and information to determine phases of the down-mixed channels are coded together with audio of the down-mixed channels, the control unit 112 selects the channel in which the additional information can be coded at the highest compression rate.

As described above with reference to FIG. 3, the information to determine powers of down-mixed channels may be information about the angle between the vector of the power of the mono-channel and the vector of the power of the channel p, or may be information about the angle between the vector of the power of the mono-channel and the vector of the power of the channel q. Thus, the control unit 112 selects the channel in which information about θI may be coded at the highest compression rate. If the information about θI may be coded at a higher compression rate in the down-mixing of the channels Ch.1 and Ch.11 than the down-mixing of the channels Ch.5 and Ch.13, the channels Ch.1 and Ch.11 are selected as down-mix target channels. For example, if the information about θI may be coded at a higher compression rate in the case of a small θI than in the case of a large θI, two channels having small θI are selected as down-mix target channels.

This is the same when only a correlation between adjacent channels is calculated. When the control unit 112 calculates correlations among adjacent channels shown in FIG. 5, the correlation between the channels Ch.1 and Ch.11, and the correlation between the channels Ch.1 and Ch.20 may be equal to each other and may be the highest levels. Here, the control unit 112 may select two channels, in which additional information to restore multi-channels from a down-mixed channel may be coded at a highest compression rate, as down-mix target channels, wherein the additional information is generated by the additional information generating unit 120.

Figure 8:
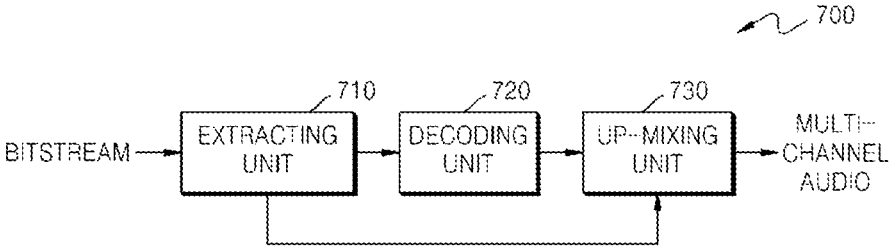
FIG. 8 illustrates an apparatus for decoding multi-channel audio, according to an exemplary embodiment.

FIG. 8 illustrates an apparatus 700 for decoding multi-channel audio, according to an exemplary embodiment.

Referring to FIG. 8, the apparatus 700 for decoding multi-channel audio (hereinafter, referred to as 'multi-channel audio decoding apparatus 700') includes an extracting unit 710 (e.g., extractor), a decoding unit 720 (e.g., decoder), and an up-mixing unit 730 (e.g., up-mixer).

The extracting unit 710 extracts coded audio and additional information from received audio data, i.e., a bitstream. The coded audio may be generated in such a manner that N-channel audio is down-mixed to one mono-channel audio or M-channel audio and then an audio signal is coded by using a predetermined algorithm.

The decoding unit 720 decodes the coded audio and additional information which are extracted by the extracting unit 710. The decoding unit 720 decodes the coded audio and additional information by using the same algorithm used in the coding. When the coded audio is decoded, the one mono-channel audio or the M-channel audio may be restored.

The up-mixing unit 730 up-mixes the audio decoded by the decoding unit 720, and thus restores the N-channel audio to a state prior to down-mixing. The up-mixing unit 730 restores the N-channel audio based on the additional information decoded by the decoding unit 720. The up-mixing unit 730 performs the down-mixing procedure, which is described above with reference to FIGS. 4 through 6, in a reverse manner based on the additional information, and thus up-mixes down-mixed audio to multi-channel audio.

Since the additional information includes information about the down-mixing order of channels, the up-mixing unit 730 separates the channels from the mono-channel according to the down-mixing order, in consideration of the additional information. By determining powers and phases of down-mixed channels according to the information to determine powers and phases of down-mixed channels, the channels may be sequentially separated from the mono-channel.

Figure 9:
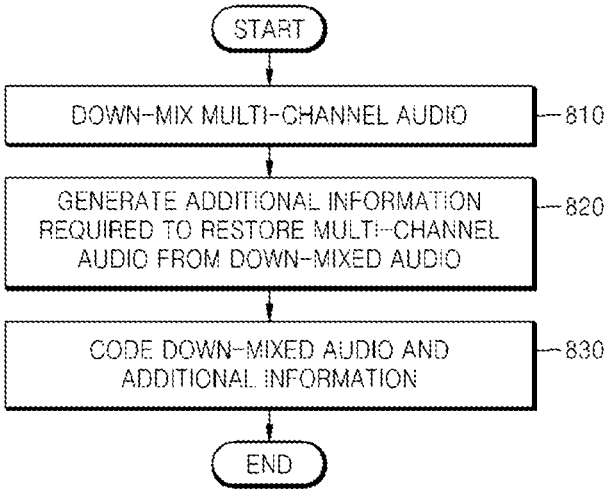
FIG. 9 is a flowchart illustrating a method of coding multi-channel audio, according to an exemplary embodiment.

FIG. 9 is a flowchart illustrating a method of coding multi-channel audio, according to an exemplary embodiment.

Referring to FIG. 9, in operation 810, the multi-channel audio coding apparatus 100 down-mixes the multi-channel audio. As described above with reference to FIGS. 4 through 6, the multi-channel audio coding apparatus 100 repeats a process of selecting down-mix target channels based on a calculation of a correlation between N-channels and down-mixing the down-mix target channels, and thus generates one final mono-channel audio or M-channel audio.

In operation 820, the multi-channel audio coding apparatus 100 generates additional information for restoring the multi-channel audio from audio that is generated by performing the down-mixing in operation 810. As described above with reference to the additional information generating unit 120, information to determine powers and phases of down-mixed channels may be generated as the additional information. Also, while the channels are being sequentially down-mixed, information about a down-mixing order of the channels may be generated as the additional information.

In operation 830, the multi-channel audio coding apparatus 100 codes the down-mixed audio generated in operation 810, and the additional information generated in operation 820.

Figure 10:
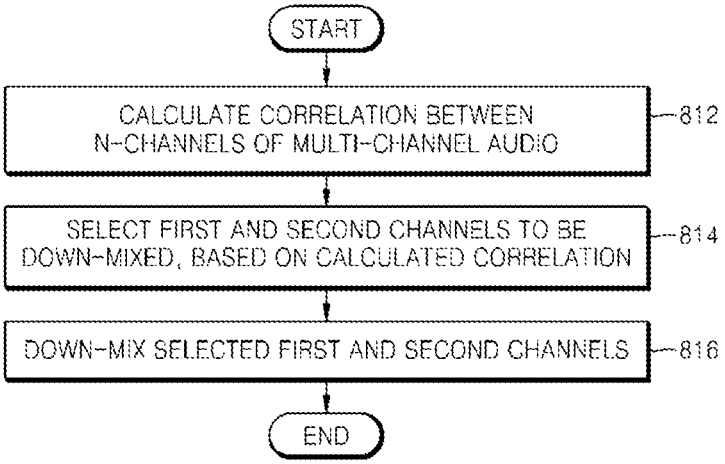
FIG. 10 is a flowchart illustrating a down-mixing method, according to an exemplary embodiment.

FIG. 10 is a flowchart illustrating a down-mixing method, according to an exemplary embodiment. FIG. 10 illustrates, in detail, operation 810 of FIG. 9.

Referring to FIG. 10, in operation 812, the down-mixing device 110 calculates correlations between N-channels of the multi-channel audio. By using exemplary Equation 2, the down-mixing device 110 may calculate a cross-correlation between the channels in a time domain or a frequency domain. If there is a mono-channel that is previously generated via down-mixing, the down-mixing device 110 may calculate a correlation between the mono-channel and other channels that are not down-mixed yet.

In operation 814, the down-mixing device 110 selects two down-mix target channels, i.e., a first channel and a second channel, based on a result of the calculation in operation 812. According to the result of the calculation in operation 812, two channels having a highest cross-correlation therebetween are selected. If two or more pairs of the channels have a highest cross-correlation therebetween, two channels, in which the additional information can be coded at a highest compression rate, are selected as the two down-mix target channels. The additional information may be information to determine powers and phases of the two down-mix target channels. The information to determine powers and phases of the two down-mix target channels may be information about an angle between a vector of a power of the mono-channel and a vector of a power of the down-mix target channel.

In operation 816, the down-mixing device 110 down-mixes the first and second channels selected in operation 814.

The down-mixing device 110 repeats operations 812 through 816 until the down-mixing is completed and thus the mono-channel audio or the M-channel audio are generated.

Figure 11:
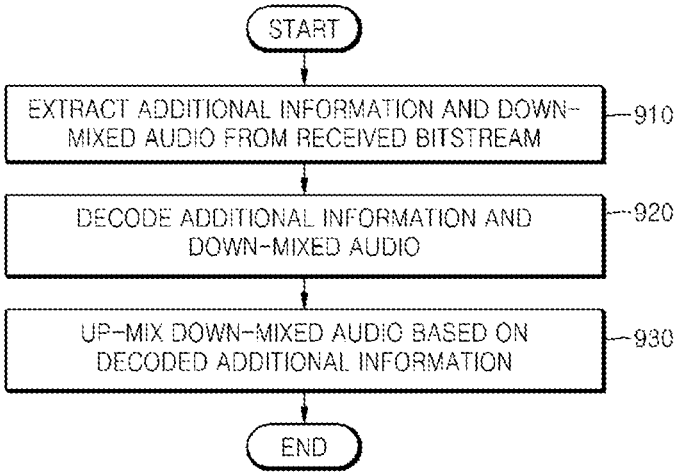
FIG. 11 is a flowchart illustrating a method of decoding multi-channel audio, according to an exemplary embodiment.

FIG. 11 is a flowchart illustrating a method of decoding multi-channel audio, according to an exemplary embodiment.

Referring to FIG. 11, in operation 910, the multi-channel audio decoding apparatus 700 extracts additional information and down-mixed audio. The multi-channel audio decoding apparatus 700 extracts the additional information and the down-mixed audio from audio data, i.e., a bitstream, wherein the additional information is for restoring multi-channels from the down-mixed audio.

In operation 920, the multi-channel audio decoding apparatus 700 decodes the additional information and the down-mixed audio which are extracted in operation 910. The additional information and the down-mixed audio are decoded by using the same algorithm used when the multi-channel audio is coded.

In operation 930, the multi-channel audio decoding apparatus 700 up-mixes the down-mixed audio based on the additional information decoded in operation 920. The multi-channel audio decoding apparatus 700 up-mixes the down-mixed audio based on the additional information described above with reference to the additional information generating unit 120, and thus restores the multi-channel audio.

According to exemplary embodiments, channels having a high correlation therebetween are down-mixed based on a correlation between N-channels, so that a multi-channel audio may be coded at a high compression rate.

An exemplary embodiment may also be embodied as computer-readable codes on a computer-readable recording medium. For example, each of the down-mixing device, the multi-channel audio coding apparatus, the multi-channel audio decoding apparatus, and elements thereof shown in FIGS. 1 and 7 according to exemplary embodiments may include at least one of circuitry, a bus coupled to each apparatus, and at least one processor coupled to the bus. Also, each of the down-mixing unit, the multi-channel audio coding apparatus, the multi-channel audio decoding apparatus, and elements thereof shown in FIGS. 1 and 7 according to exemplary embodiments may include a memory coupled to the at least one processor that is coupled to the bus so as to store commands, received messages, or generated messages, and to execute the commands.

In addition, the computer readable recording medium may be any data storage device that can store data which can be thereafter read by a computer system. Examples of the computer readable recording medium include read-only memory (ROM), random-access memory (RAM), CD-ROMs, magnetic tapes, floppy disks, optical data storage devices, etc. The computer readable recording medium can also be distributed over network coupled computer systems so that the computer readable code is stored and executed in a distributed fashion.

While exemplary embodiments have been particularly shown and described above, it will be understood by those of ordinary skill in the art that various changes in form and details may be made therein without departing from the spirit and scope of the present inventive concept as defined by the following claims.

What is claimed is:

1. A method of down-mixing multi-channel audio, the method comprising:

calculating first correlations between channels of the multi-channel audio;

selecting a first channel and a second channel, among the channels of the multi-channel audio, that are to be down-mixed, based on the calculated first correlations;

down-mixing the selected first channel and the selected second channel, wherein two channels, included in a channel pair having a highest correlation, are selected as the first channel and the second channel, and wherein, if two or more channel pairs have a same value of the highest correlation, two channels in which at least one piece of additional information for restoring the channels to a state before the down-mixing, to be coded at a highest compression rate, are selected as the first channel and the second channel.

2. The method of claim 1, wherein the calculating the first correlations comprises calculating cross-correlations between the channels in a unit of a frame.

3. The method of claim 2, wherein the calculating the cross-correlations comprises calculating cross-correlations between channels, among the channels of the multi-channel audio, that are determined to be spatially adjacent to each other in the unit of the frame.

4. The method of claim 1, wherein the at least one piece of additional information comprises additional information for restoring powers of the two channels to the state before the down-mixing.

5. The method of claim 1, further comprising:

calculating second correlations between channels including a mono channel, which is generated as a result of the down mixing the selected first channel and the selected second channel, and including other channels of the multi-channel audio other than the selected first channel and the selected second channel;

selecting a third channel and a fourth channel that are to be down-mixed, based on the calculated second correlations; and down-mixing the selected third channel and the selected fourth channel.

6. The method of claim 1, further comprising:

calculating second correlations between a mono-channel, which is generated as a result of the down-mixing the selected first channel and the selected second channel, and other channels of the multi-channel audio other than the selected first channel and the selected second channel;

selecting a third channel to be down-mixed with the mono-channel, based on the calculated second correlations; and down-mixing the mono-channel and the selected third channel.

7. A down-mixing device for down-mixing multi-channel audio, the down-mixing device comprising:

a controller which calculates first correlations between channels of the multi-channel audio, and selects a first channel and a second channel, among the channels of the multi-channel audio, that are to be down-mixed, based on the calculated first correlations; and a down-mixer which down-mixes the selected first channel and the selected second channel, wherein two channels, included in a channel pair having a highest correlation, are selected as the first channel and the second channel, and wherein, if two or more channel pairs have a same value of the highest correlation, two channels in which at least one piece of additional information for restoring the channels to a state before the down-mixing, to be coded at a highest compression rate, are selected as the first channel and the second channel.

8. The down-mixing device of claim 7, wherein the controller calculates cross-correlations between the channels in a unit of a frame.

9. The down-mixing device of claim 8, wherein the controller calculates cross-correlations between channels, among the channels of the multi-channel audio, that are determined to be spatially adjacent to each other in the unit of the frame.

10. The down-mixing device of claim 7, wherein the at least one piece of additional information comprises additional information for restoring powers of the two channels to the state before the down-mixing.

11. The down-mixing device of claim 7, wherein:

the controller calculates second correlations between channels including a mono channel, which is generated as a result of the down mixing the selected first channel and the selected second channel, and including other channels of the multi-channel audio other than the selected first channel and the selected second channel, and selects a third channel and a fourth channel that are to be down-mixed, based on the calculated second correlations; and the down-mixer down-mixes the selected third channel and the selected fourth channel.

12. The down-mixing device of claim 7, wherein:

the controller calculates second correlations between a mono-channel, which is generated as a result of the down-mixing the selected first channel and the selected second channel, and other channels of the multi-channel audio other than the selected first channel and the selected second channel, and selects a third channel to be down-mixed with the mono-channel, based on the calculated second correlations; and the down-mixer down-mixes the mono-channel and the selected third channel.

13. A computer-readable recording medium having recorded thereon a program for executing the method of claim 1.

14. A method of down-mixing multi-channel audio, the method comprising:

selecting a first channel and a second channel, among channels of multi-channel audio, that are to be down-mixed, based on correlations between the channels of the multi-channel audio; and down-mixing the selected first channel and the selected second channel, wherein two channels, included in a channel pair having a highest correlation, are selected as the first channel and the second channel, and wherein, if two or more channel pairs have a same value of the highest correlation, two channels in which at least one piece of additional information for restoring the channels to a state before the down-mixing, to be coded at a highest compression rate, are selected as the first channel and the second channel.

15. The method of claim 14, further comprising generating additional information indicating the selected first channel and the selected second channel are down-mixed, the generated additional information for restoring the multi-channel audio to a state before the down-mixing.

16. A computer-readable recording medium having recorded thereon a program for executing the method of claim 14.

* * * * *